US007874362B2

(12) United States Patent
Coates et al.

(10) Patent No.: US 7,874,362 B2
(45) Date of Patent: Jan. 25, 2011

(54) DETERMINATION OF DOWNHOLE PRESSURE WHILE PUMPING

(75) Inventors: Richard Timothy Coates, Middlebury, CT (US); Douglas E. Miller, Sandy Hook, CT (US); Philip Sullivan, Bellaire, TX (US); Francois Auzerais, Houston, TX (US); Tarek M. Habashy, Burlington, MA (US)

(73) Assignee: Schlumberger Technology Corporation, Cambridge, MA (US)

( * ) Notice: Subject to any disclaimer, the term of this patent is extended or adjusted under 35 U.S.C. 154(b) by 389 days.

(21) Appl. No.: 11/691,117

(22) Filed: Mar. 26, 2007

(65) Prior Publication Data

US 2008/0236935 A1 Oct. 2, 2008

(51) Int. Cl.
*E21B 47/09* (2006.01)

(52) U.S. Cl. ..... 166/299; 166/255.1; 166/250.01

(58) Field of Classification Search ..... 166/250.07, 166/255.1, 299; 181/105, 139; 367/83, 146, 367/911

See application file for complete search history.

(56) References Cited

U.S. PATENT DOCUMENTS 2,361,558 A * 10/1944 Mason ..... 166/299
2,396,935 A 3/1946 Walstrom
2,425,869 A 8/1947 Dillon
2,999,557 A 9/1961 Smith
3,127,950 A * 4/1964 Itria ..... 367/26
3,134,437 A 5/1964 Karpovich
3,399,745 A * 9/1968 Sparks ..... 367/63
3,475,722 A * 10/1969 White ..... 367/31
3,483,505 A * 12/1969 Wottlin et al. ..... 367/31
3,500,950 A * 3/1970 Roever ..... 367/103

(Continued)

FOREIGN PATENT DOCUMENTS

GB 2312063 A 10/1997

(Continued)

OTHER PUBLICATIONS

Doublet et al., Pressure Transient Data Acquisition and Analysis Using Real Time Electromagnetic Telemetry, SPE 35161, 1996, pp. 149-165.

(Continued)

*Primary Examiner*—Shane Bomar
*Assistant Examiner*—Blake Michener
(74) *Attorney, Agent, or Firm*—Vincent Loccisano; James McAleenan; Brigid Laffey

(57) ABSTRACT

Tubewaves are used to transmit an indication of the depth at which a condition is detected in a well. In particular, the depth is calculated based on the difference in arrival time at the surface of a first tubewave which propagates directly upward in the borehole and a second tubewave which initially travels downward and is then reflected upward. The tubewaves may be generated by a canister designed to implode at a certain pressure. The canister is carried downhole by gravity and the fluid being pumped. At a depth at which its pressure tolerance is exceeded, it implodes and generates the tubewaves. An analyzer at the surface detects the tubewaves and generates a pressure versus depth profile of the well. Canisters may be acoustically tagged in order to generate tubewaves having particular frequency and amplitude characteristics. Canisters may also be configured to produce multiple implosions.

61 Claims, 6 Drawing Sheets

U.S. PATENT DOCUMENTS

| | | | | | |
|---|---|---|---|---|---|
| 3,990,512 | A | | 11/1976 | Kuris | |
| 4,168,483 | A | | 9/1979 | Parthasarathy et al. | |
| 4,206,810 | A | | 6/1980 | Blackman | |
| 4,300,654 | A | * | 11/1981 | Raymond et al. | 181/120 |
| 4,575,830 | A | * | 3/1986 | Ingram et al. | 367/26 |
| 4,703,460 | A | | 10/1987 | Kurkjian et al. | |
| 4,805,726 | A | | 2/1989 | Taylor et al. | |
| 4,811,814 | A | | 3/1989 | Staron et al. | |
| 4,858,718 | A | * | 8/1989 | Chelminski | 181/106 |
| 4,872,526 | A | | 10/1989 | Wignall et al. | |
| 5,109,698 | A | | 5/1992 | Owen | |
| 5,109,947 | A | | 5/1992 | Rector | |
| 5,136,549 | A | | 8/1992 | Berglund | |
| 5,170,018 | A | | 12/1992 | Potier | |
| 5,331,604 | A | | 7/1994 | Chang et al. | |
| 5,537,364 | A | * | 7/1996 | Howlett | 367/57 |
| H1663 | H | * | 7/1997 | Yen | 367/146 |
| 5,831,934 | A | * | 11/1998 | Gill et al. | 367/25 |
| 6,196,350 | B1 | | 3/2001 | Minto | |
| 6,352,109 | B1 | * | 3/2002 | Buckman, Sr. | 166/250.03 |
| 6,397,950 | B1 | * | 6/2002 | Streich et al. | 166/376 |
| 6,456,566 | B1 | * | 9/2002 | Aronstam | 367/86 |
| 6,856,912 | B2 | * | 2/2005 | Fehmers et al. | 702/14 |
| 7,134,492 | B2 | | 11/2006 | Willberg et al. | |
| 2004/0226715 | A1 | | 11/2004 | Willberg | |
| 2008/0110691 | A1 | | 5/2008 | Chang et al. | |
| 2008/0239872 | A1 | * | 10/2008 | Miller et al. | 367/83 |
| 2009/0159272 | A1 | * | 6/2009 | Auzerais et al. | 166/250.01 |

FOREIGN PATENT DOCUMENTS

| | | | |
|---|---|---|---|
| WO | 0016128 | A1 | 3/2000 |
| WO | 0054009 | A | 9/2000 |
| WO | 2004074633 | A | 9/2004 |
| WO | 2006000742 | A | 1/2006 |

OTHER PUBLICATIONS

Fisher et al., Real-Time Bottomhole Data Can Improve Accuracy of Fracture Diagnostics, GRI GasTips, 1996/1997, vol. 3, pp. 20-25.

Ghiotto et al., Investigating the Acoustic Properties of the Underwater Implosions of Light Globes and Evacuated Spheres, Australian Acoustical Society Conference, Nov. 15-17, 200, pp. 223-231.

Heard et al., Underwater Light Bulb Implosions: A Useful Acoustic Source, Proc IEEE Oceans, 1997, pp. 755-762.

Marzetta et al., One-dimensional implosions under gravity-induced hydrostatic pressure, J. Acoust. Soc. Am., vol. 82, No. 6, Dec. 1987, pp. 2090-2101.

Orr et al., Acoustic signatures from deep water implosions of spherical cavities, J. Acoust. Soc. Am., vol. 59, May 1976, pp. 1155-1159.

Harben et al., Use of Imploding Spheres: an Alternative to Explosives as Acoustic Sources at Mid-Latitude SOFAR Channel Depths, Lawrence Livermore National Laboratory Report, UCRL-ID-139032, May 2000, pp. 1-10.

Economides et al., Reservoir Stimulation, John Wiley & Sons, Ltd., 2000, Chapter 9.

Urick, Implosions as Sources of Underwater Sound, J. Acoustic Soc. Am., vol. 35, pp. 2026-2027.

White, Underground Sound: Application of Seismic Waves, Elsevier, ISBN 0-444-42139-4, pp. 139-188.

Patent Cooperation Treaty, PCT Written Opinion of the International Search Authority, dated Oct. 8, 2009, 8 pages.

* cited by examiner

Canister 300

Canister 500

Canister 600

DETERMINATION OF DOWNHOLE PRESSURE WHILE PUMPING

FIELD OF THE INVENTION

This invention is generally related to oil and gas wells, and more particularly to measurement of downhole pressure in a borehole during pumping operations.

CROSS-REFERENCE TO RELATED APPLICATIONS

This patent application is also related to the following commonly-assigned U.S. Patent Application which is hereby incorporated by reference in its entirety: application Ser. No. 11/691,071, entitled "Wireless Logging of Fluid Filled Boreholes", filed on this same date.

BACKGROUND OF THE INVENTION

Achieving accurate, real-time bottom hole pressure measurements during borehole stimulation treatments has long been a goal in the oil and gas industry. During fracture treatments, in particular, accurate measurement of bottom hole pressure would allow an operator to observe fracture growth trends in real-time, and change treatment conditions accordingly. However, real-time measurements of bottom hole pressure are rarely performed with current technology because the abrasiveness of a fracturing slurry is destructive to any exposed cable placed in the wellbore for delivering data to the surface. Downhole memory gauges are sometimes used for selected treatments, but these do not enable real-time decision making during the treatment because their data is not delivered to the surface until after the treatment is over.

One attempt to deliver bottom hole pressure measurement data in real-time is described in Doublet, L. E., Nevans, J. W., Fisher, M. K., Heine, R. L, Blasingame, T. A., *Pressure Transient Data Acquisition and Analysis Using Real Time Electromagnetic Telemetry, SPE* 35161, March 1996 ("Doublet"). Doublet teaches that pressure measurements are transmitted from a downhole gauge to the surface through the formation strata via electromagnetic signals. Although this technique has been used successfully on some wells, it is limited by the borehole depth and the types of rock layers through which a signal could be transmitted clearly. In particular, electromagnetic signals are rapidly attenuated by the formation. These limitations render the technique impractical for use in many wells, and particularly in deep wells.

It is known that implosions at depth in a fluid filled borehole are effective seismic sources. For example, imploding spheres and other shapes have been used as underwater acoustic sources for ocean applications as described in Heard, G. J., McDonald, M., Chapman, N. R., Jashke, L., "Underwater light bulb implosions—a useful acoustic source," Proc IEEE Oceans '97; M. Orr and M. Schoenberg, "Acoustic signatures from deep water implosions of spherical cavities," J. Acoustic Society Am., 59, 1155-1159, 1976; R. J. Urick, "Implosions as Sources of Underwater Sound," J. Acoustic Society Am, 35, 2026-2027, 1963; and Giotto, A., and Penrose, J. D., "Investigating the acoustic properties of the underwater implosions of light globes and evacuated spheres," Australian Acoustical Society Conference, Nov. 15-17, 2000. Typically, a device with a vacuum or low pressure chamber is released into the water to sink and eventually implode when the hydrostatic pressure exceeds implosion threshold of the device. A triggering mechanism may be used to cause the device to implode before pressure alone would do so as described in Harben, P. E., Boro, C., Dorman, Pulli, J., 2000, "Use of imploding spheres: an Alternative to Explosives as Acoustic Sources at mid-Latitude SOFAR Channel Depths," *Lawrence Livermore National Laboratory Report, UCRL-ID*-139032. One example of an implosive device is commercial light bulbs, as described in both Heard, G. J., McDonald, M., Chapman, N. R., Jashke, L., "Underwater light bulb implosions—a useful acoustic source," Proc IEEE Oceans '97; and Giotto. The controlled use of implosive sources in a wellbore is described in U.S. Pat. No. 4,805,726 of Taylor, D. T., Brooks, J. E., titled "Controlled Implosive Downhole Seismic Source." Seismic sources generate low frequency tubewaves which propagate up and down the borehole over long distances with a clearly defined velocity and little dispersion, particularly in cased wells. Indeed, tubewaves propagate with so little attenuation that they are the major source of noise in conventional borehole seismic surveys. Tubewaves are described, for example, in White, J. E., 1983, "Underground Sound: Application of Seismic Waves," Elsevier, ISBN 0-444-42139-4 ("White").

SUMMARY OF THE INVENTION

In accordance with one embodiment of the invention, apparatus operable to facilitate calculation of a depth at which a condition occurs in a borehole containing a fluid, the borehole having a head and a bottom, comprises: a hollow body which defines a chamber; and a feature which initiates generation of a tubewave based on exposure to a predetermined value of at least one physical property selected from the group including pressure, time, temperature, pH, and background radiation.

In accordance with another embodiment of the invention, apparatus operable to calculate a depth at which a condition occurs in a borehole containing a fluid, the borehole having a head and a bottom, comprises: a canister operable in response to occurrence of the condition at a first position in the borehole to generate first and second tubewaves in the well, the first tubewave propagating from the position directly toward the head, and the second tubewave propagating from the position toward the bottom of the borehole and then being reflected toward the head; at least one sensor operable to detect arrival of the first and second tubewaves at a second position of known depth; and an analyzer operable to calculate depth of the first position relative to the depth of the bottom of the borehole or other reflector as a function of difference in detected arrival time of the first and second tubewaves at the second position.

In accordance with another embodiment of the invention, a method for facilitating calculation a depth at which a condition occurs in a borehole containing a fluid, the borehole having a head and a bottom, comprises: generating a tubewave with a hollow body which defines a chamber and a feature which initiates generation of the tubewave based on exposure to a predetermined value of at least one physical property selected from the group including pressure, time, temperature, pH, and background radiation.

In accordance with another embodiment of the invention, a method for calculating a depth at which a condition occurs in a borehole containing a fluid, the borehole having a head and a bottom, comprises: generating, with a canister operable in response to occurrence of the condition at a first position in the borehole, first and second tubewaves in the borehole, the first tubewave propagating from the position directly toward the head, and the second tubewave propagating from the position toward the bottom of the borehole and then being reflected toward the head; detecting arrival of the first and second tubewaves at a second position of known depth with at least one sensor; and employing an analyzer to calculate depth of the first position relative to the depth of the bottom of the borehole or other reflector as a function of difference in detected arrival time of the first and second tubewaves at the second position.

DETAILED DESCRIPTION

Figure 1:
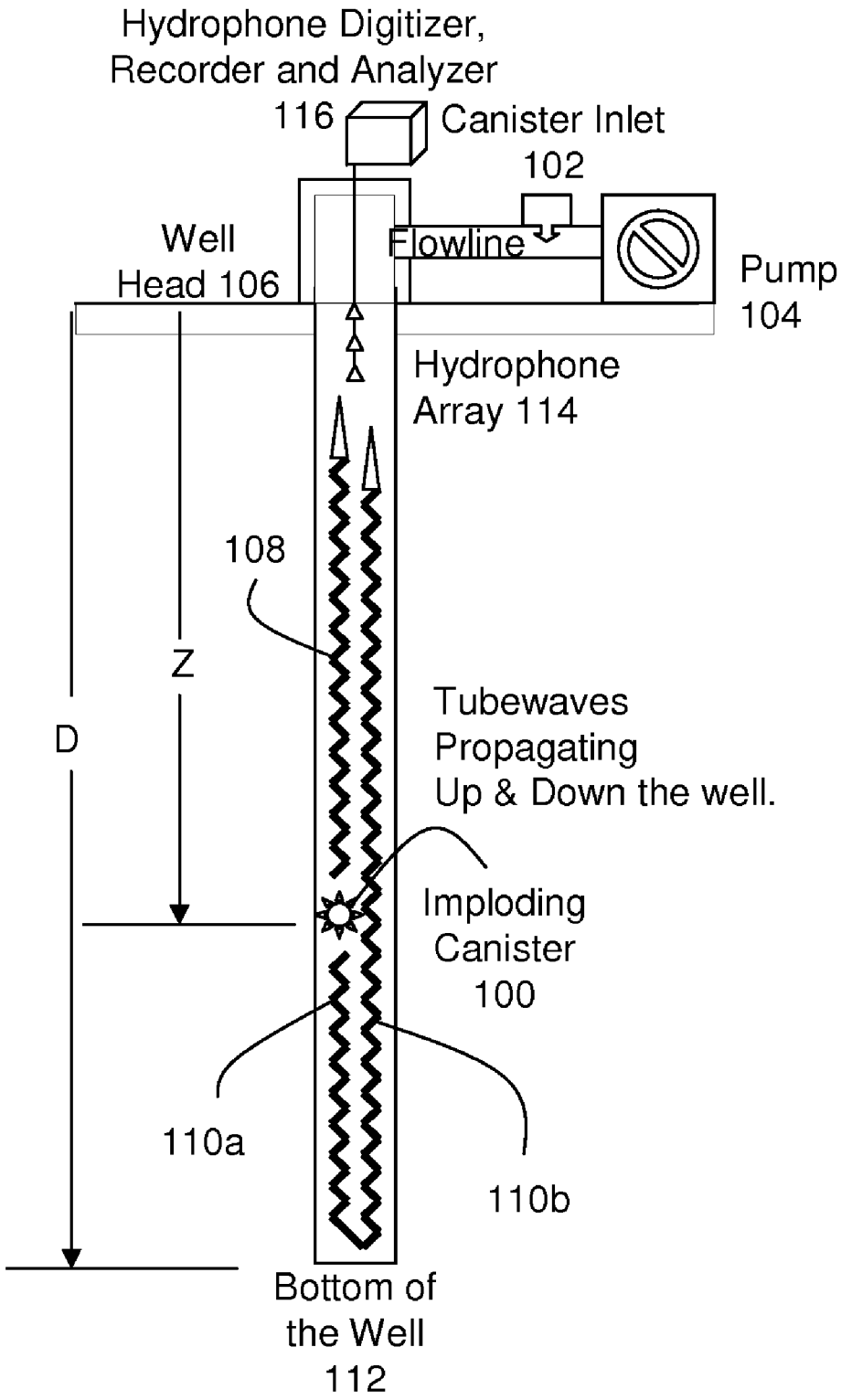
FIG. 1 is a schematic illustrating the use of an imploding canister in a borehole to determine a pressure-depth relationship along the length of the borehole

FIG. 1 illustrates use of an imploding canister (100) in a borehole to determine a pressure-depth relationship along the length of the borehole. The canister is introduced into the fluid being pumped into the borehole via an inlet (102) between the pump (104) and the borehole head (106). The canister (100) is designed to implode when the pressure to which it is subjected exceeds a predetermined implosion value, e.g., 300 PSI. Once introduced into the fluid, the canister is carried down the borehole by at least one of (a) the fluid being pumped and (b) the force of gravity. When the pressure to which the canister is subjected exceeds the implosion value, e.g., 300 PSI, the canister implodes. The implosion of the canister generates strong tubewaves (108, 110) which travel both up and down the well, i.e., an up-going tubewave (108) and a down-going tube wave (110*a*). The up-going tubewave (108) propagates upward through the borehole to the borehole head (106) at the surface. The down-going tubewave (110*a*) propagates downward and is strongly reflected by the bottom of the borehole (112). The reflected, down-going tubewave (100*b*) propagates upward to the borehole head. The direct up-going and reflected down-going tubewaves are detected by one or more sensors (114) at or near the borehole head. For example, a hydrophone or short array of hydrophones may be employed to detect the tubewaves. A hydrophone digitizer, recorder, and analyzer (116) having a clock circuit is employed to measure and record the difference in time between detection of the tubewaves (108, 110*b*). The depth at which the implosion occurred is then calculated by the analyzer (116) from the time-lag between the direct up-going tubewave (108) and the reflected down-going tubewave (110*b*), yielding a depth Z (measured along the length of the borehole from the bottom of the well (112)) at which the pressure exceeds the implosion value (300 PSI in our example). Since the implosion value is known, the result is a data point indicative of pressure at the depth Z.

It should be noted that the down-going tubewave (110*a*) may be reflected before reaching the bottom of the borehole (112). For example, a major change in borehole impedance may cause reflection of the down-going tubewave. In some cases it may be necessary to distinguish that reflection from a reflection at the bottom of the well. In other cases where the depth of the feature is known, the tubewave reflected by the feature may be employed in the depth calculation. Other signals generated by the implosion such as extensional or flexural waves in the casing might also be detected at the surface. If they are present and have known propagation speed then they may be used as an additional or alternative method for determining the depth of the implosion. Still other signals, such as those generated by a pump, may need to be removed by filtering.

Various techniques may be employed to calculate implosion depth from the delta of tubewave arrival times. For example, the propagation speed, V, of the tubewave in a fluid-filled cased borehole is described by White (1983) as:

$$V=\{\rho(1/B+1/(\mu+(Eh/2b))]^{-1/2}.$$

where ρ is fluid density, B is the bulk modulus of the fluid, μ is the shear modulus of the rock, E is Young's modulus for the casing material, h is the casing thickness and b is the casing outer diameter. For a water-filled borehole, an acceptable approximation of V is 1450 m/s. For drilling mud this velocity may vary slightly due to increases in the density, ρ, or changes in the bulk modulus, B. Either density or bulk modulus can be measured for a particular fluid under consideration, and modifications made to the value of V if necessary.

Various techniques may be employed for calibrating the tubewave speed. For example, multiples show the total roundtrip period. Further, autocorrelation of pump noise shows the total roundtrip period. Still further, a source at surface can determine total roundtrip period.

Figure 2:
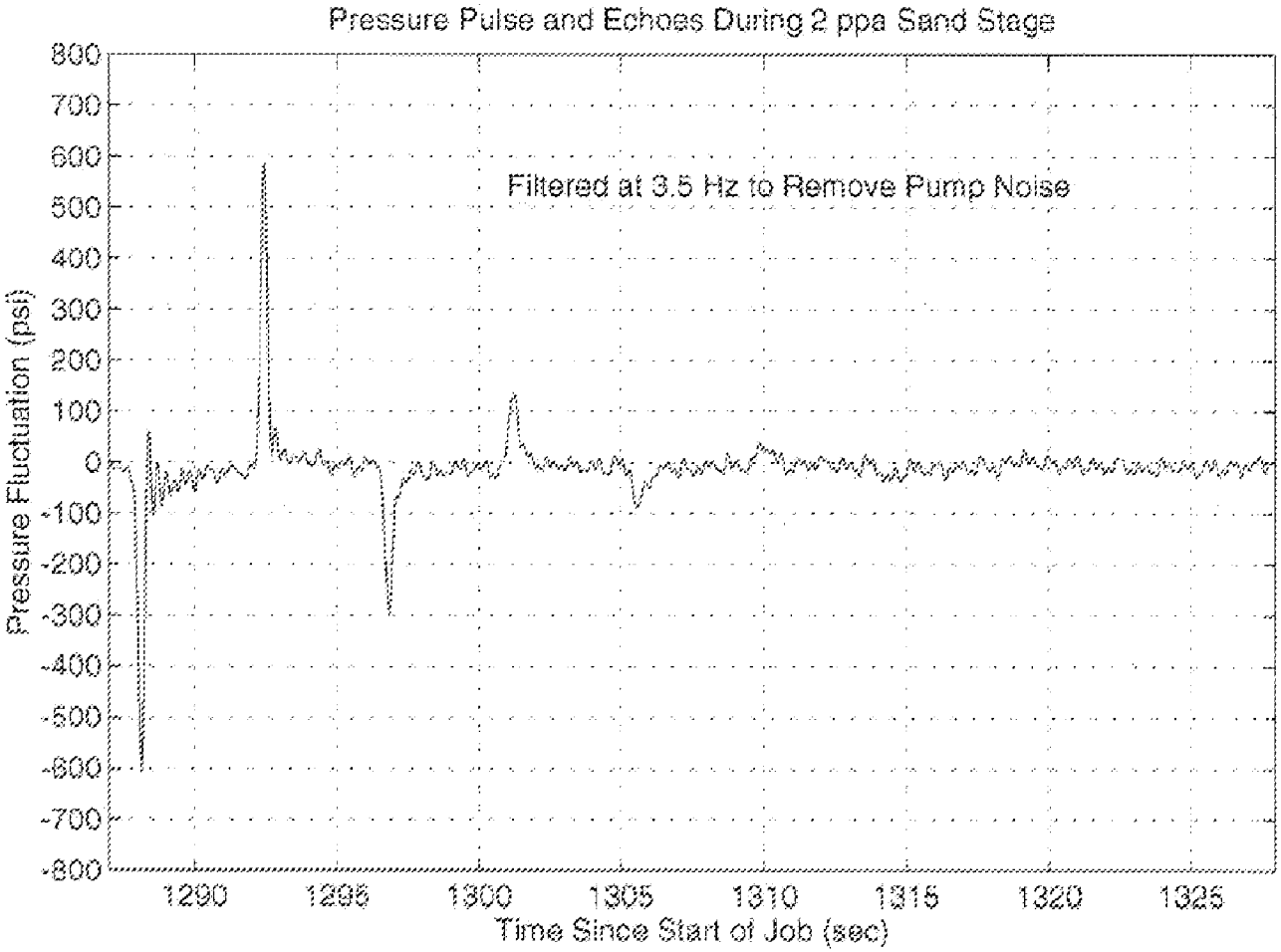
FIG. 2 is a graph illustrating reverberating pressure pulses generated by canister implosion.

In the embodiment illustrated by FIGS. 1 and 2, implosion depth is calculated for a borehole of known total depth, D, and an implosion at an unknown depth, Z, occurring at unknown time, $T_0$. The up-going tubewave (108) is detected at the hydrophone array (114) at the top of the borehole at time $T_1$. Since the time of the implosion $T_0$ and the depth, Z, are unknown, the result cannot be calculated from $T_1$ alone. However, if the arrival time of the tubewave (110*b*) reflected from the bottom of the well, $T_2$, is recorded then two equations for two unknowns are available:

$$T_1-T_0=Z/V$$

and $$T_2-T_0=(2D-Z)/V.$$

The unknown origin time can then be eliminated from these two equations to obtain an expression for the depth of the implosion:

$$Z=D-V(T_2-T_1)/2.$$

There are a variety of ways to detect tubewave arrival times and arrival delays, including manual picking, automatic thresholding algorithms, and autocorrelation based approaches. More sophisticated approaches may be required if the typical noise field is more complex, or if multiple canisters designed to implode at varying pressures are deployed simultaneously.

Using the techniques described above, multiple canisters (100) may be used to generate a multi-point pressure profile of the well. In particular, multiple canisters having different implosion values provide a profile of pressure versus depth, and multiple canisters having the same implosion value inserted sequentially over a period of time provide an indication of pressure/depth change over time. In one embodiment the multi-point pressure profile is generated by repeating the technique described above with various canisters, each of which is designed to implode at a different pressure, e.g., 100 PSI, 200 PSI, 300 PSI, 400 PSI. In particular, a second canister is introduced after implosion of a first canister, a third canister is introduced after implosion of the second canister, and so on. This procedure may be repeated in order to detect pressure profile changes in real-time.

Figure 3:
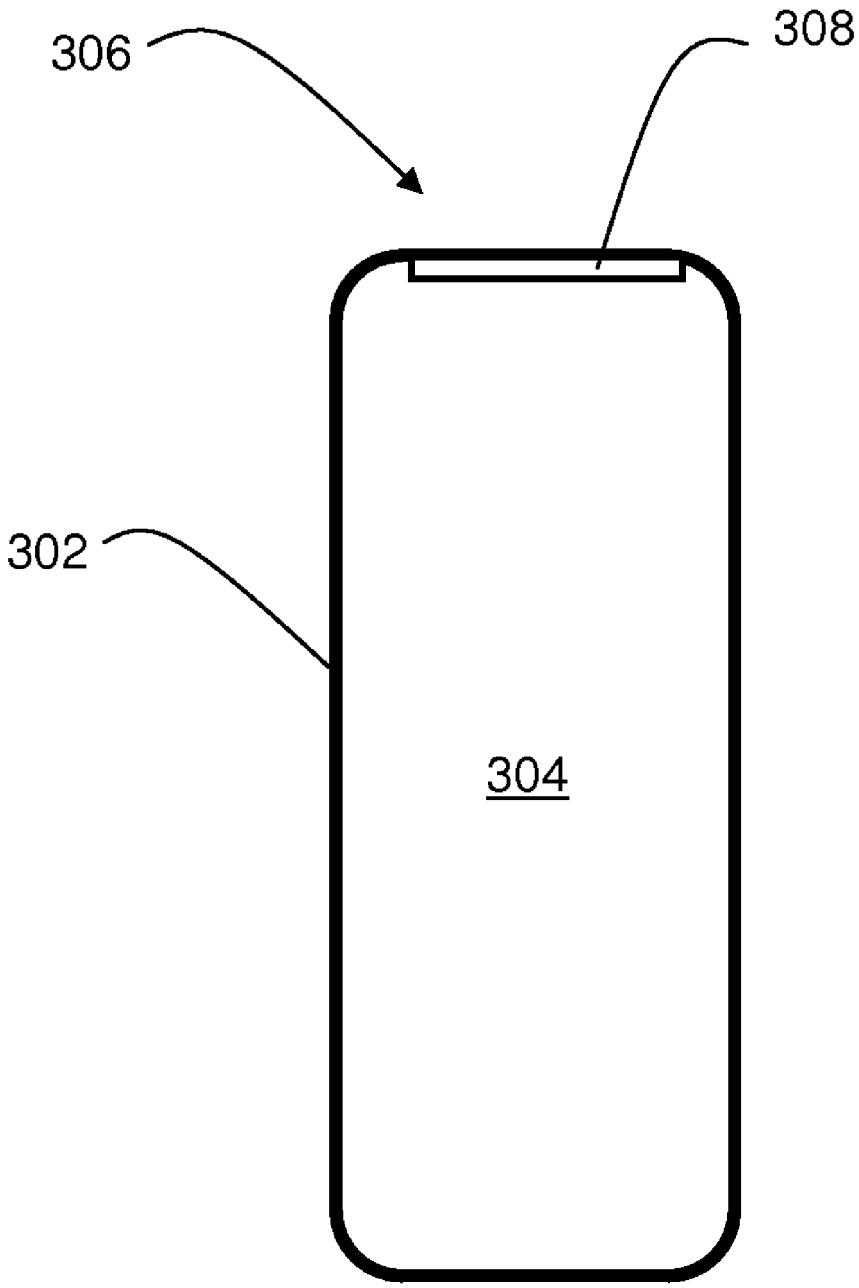
FIG. 3 is a schematic illustrating a simple imploding canister.

Referring now to FIG. 3, a simple canister (300) depicted in cross-section includes a hollow body (302) which defines an inner chamber (304). The chamber (302) may be a vacuum, or be filled with gas at zero to low pressure. Although a tubular body is depicted, spherical and other shapes may be utilized. In particular, canister shape may be selected for ease of movement within the well, and also for producing particular acoustic characteristics. The illustrated canister body has an orifice (306) adapted to receive a pressure rupture disk (308). The orifice may be threaded such that a pressure rupture disk with a threaded holder can be mated in the field to yield a canister of selected implosion value. Alternatively, canisters may be fully assembled prior to delivery to the field.

Various materials may be utilized to form the canister body. A metal body is relatively durable and easily constructed. However, if resulting debris is a concern then materials such as certain types of glass which are designed to shatter into many small pieces may be utilized. Alternatively, the metal body may be formed with fragmentation features that control debris size after implosion.

The chamber (304) volume and rupture disk (308) (or orifice) surface area may be selected to yield selected acoustic characteristics upon implosion. One factor in determining tubewave amplitude is chamber (304) size (volume). Another factor is the pressure difference between the interior and exterior of the chamber at the moment of implosion. The greater the volume of the chamber being collapsed and the greater the pressure difference, the greater the amount of energy being released, and thus the greater the amplitude of the resulting tubewave. One factor in determining tubewave frequency is the surface area of the failure during implosion, because the time over which the chamber energy is released is a function of failure surface area. Depending on the embodiment, the orifice or rupture disk may define the failure surface area during implosion. In particular, in an embodiment where the implosion value of the body (302) is sufficiently greater than that of the pressure rupture disk (308), the failure area is defined by the surface area of the pressure rupture disk which is mounted in the orifice. In an embodiment such as a glass sphere or other monolithic body, the surface area of failure may be the surface area of the body (302). In either case, the greater the surface area of failure, the less time over which the energy is released, and the greater the frequency of the resulting tubewave. The particular amplitude and frequency characteristics can be advantageously used to acoustically tag particular canisters or classes of canisters. In other words, the acoustically tagged canister produces a tubewave of particular frequency and amplitude which can be distinguished from other tubewaves and ambient energy as will be described in further detail below.

One technique for using acoustically tagged canisters is to contemporaneously introduce multiple, acoustically tagged canisters into the borehole in order to reduce the period of time required to obtain multiple pressure data points. A canister with a first implosion value has a first acoustic tag, a canister with a second implosion value has a second acoustic tag, and so on. Tubewaves from implosions received by the hydrophones are distinguished from each other by the analyzer (116) based on amplitude, frequency, or both, prior to calculation of depth. Individually calculating the depth Z of each implosion then yields a coarse depth versus pressure relationship for the borehole at the time of the survey. This procedure may be repeated in order to detect pressure profile changes over time, and in real-time.

Figure 4:
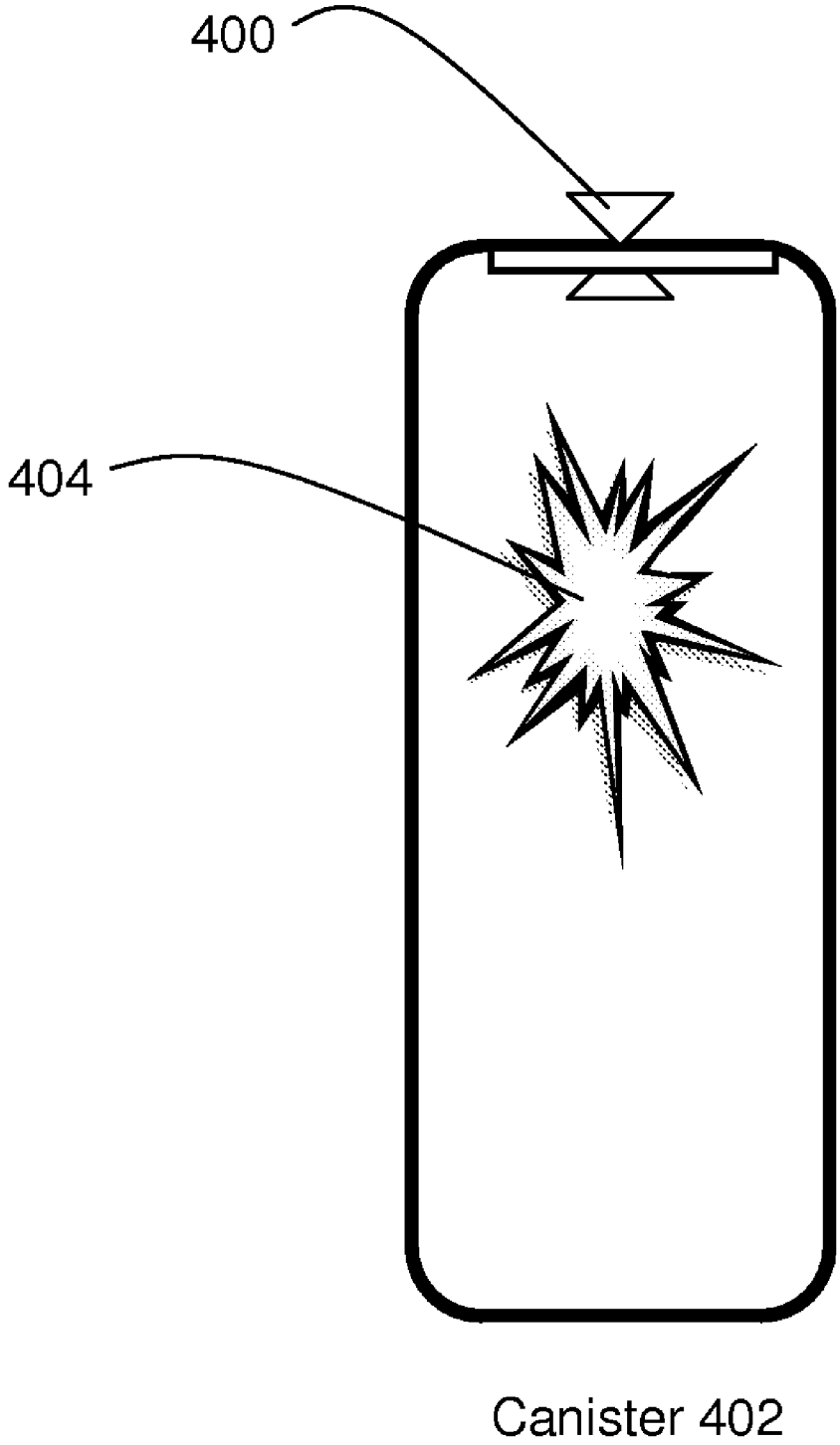
FIG. 4 is a schematic illustrating the use of a triggering device with the canister of FIG. 3.

Referring to FIG. 4, a triggering mechanism (400) is employed in an alternative canister embodiment (402). The triggering mechanism may prompt either an implosion or an explosion (404), such as by a charge or some other seismic generator such as a piezoelectric device. Further, the triggering mechanism (400) may be initiated based on any measurable physical property, including but not limited to pressure, time, temperature, pH, background radiation, and combinations thereof.

Figure 5:
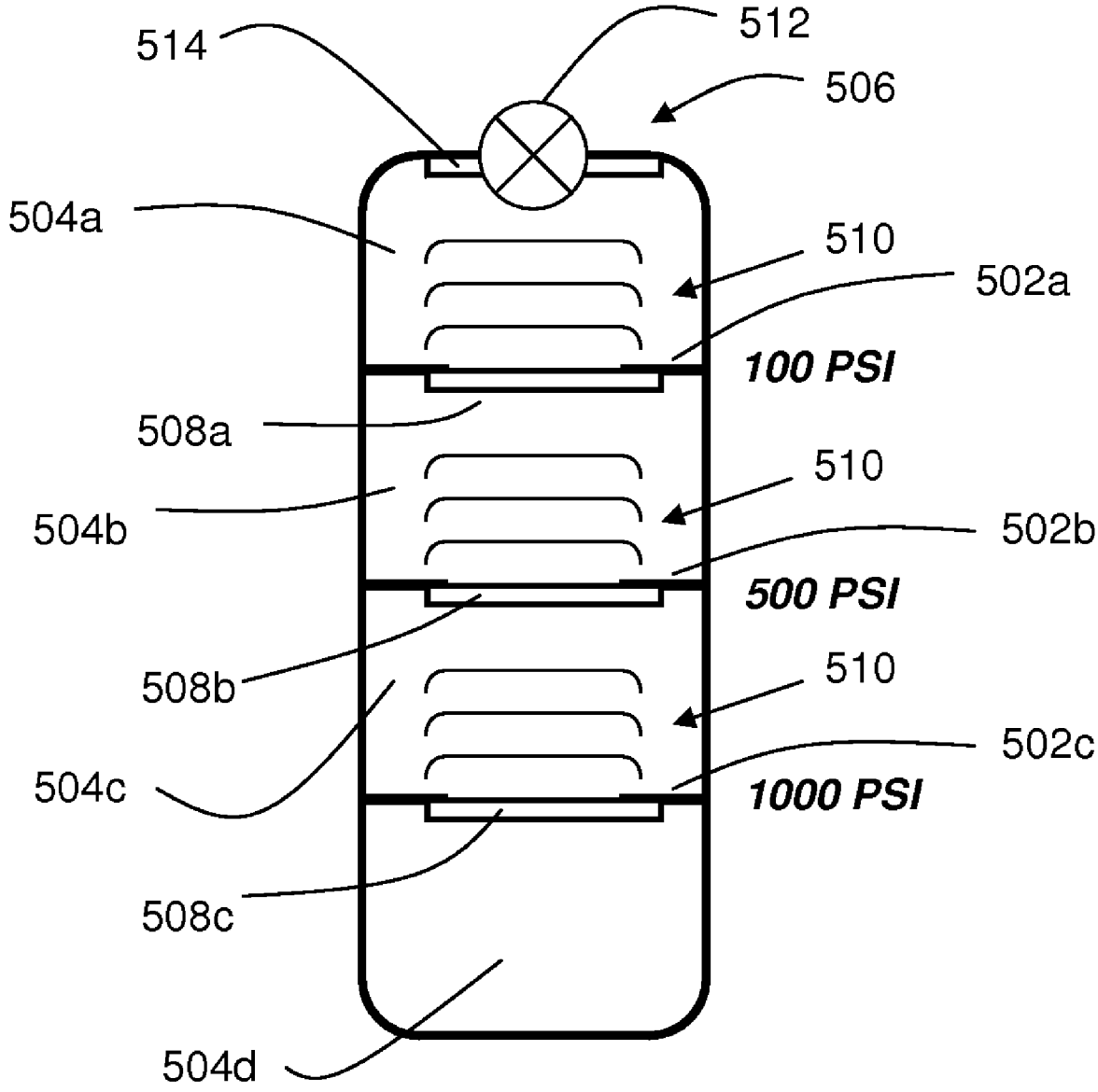
FIGS. 5 and 6 are schematics illustrating multi-implosion canisters.

FIG. 5 illustrates a multiple implosion canister (500). The canister has a body with internal partitions (502*a*, 502*b*, 502*c*)) which define four distinct chambers (504*a*, 504*b*, 504*c*, 504*d*). The first chamber (504*a*) is proximate to an external orifice (506). The internal partitions are fitted with pressure rupture disks (508*a*, 508*b*, 508*c*) rated for increasingly greater implosion value. For example, a first disk (508*a*) could be rated for 100 PSI, a second disk (508*b*) for 500 PSI, and a third disk (508*c*) for 1000 PSI. Each chamber is operable to produce tubewaves as already described above with regard to the single-chamber canister. However, the chambers implode in sequence because the failure of one rupture disk to expose the adjacent disk to the fluid under pressure. Internal baffles (510) may be employed to mitigate the possibility of premature implosion of a higher pressure rupture disk due to the energy of incoming fluid upon failure of the adjacent disk. The surface area of the rupture disks and volume of the chambers may be varied as already described above in order to acoustically tag the individual implosions.

An arming mechanism (512) is used to avoid premature implosion. In particular, the arming mechanism prevents the internal rupture disks (508*a*, 508*b*, 508*c*) from being subjected to the pressurized borehole fluid until an arming rupture disk (514) mounted at the outer orifice (506) is breached. The arming mechanism may include a timer operable to delay arming of the canister for a predetermined amount of time, e.g., to avoid premature implosion due to proximity to a pump. The arming mechanism may also be configured to avoid the specific conditions which might cause premature implosion, such as pressure pulses resulting from proximity to a pump when the canister is introduced into the well. In particular, overpressure caused by the pump could be identified based on pressure versus time characteristics, and the arming mechanism could be designed to arm the canister only after the pump pressure has been determined to have been present and then subsided.

Figure 6:
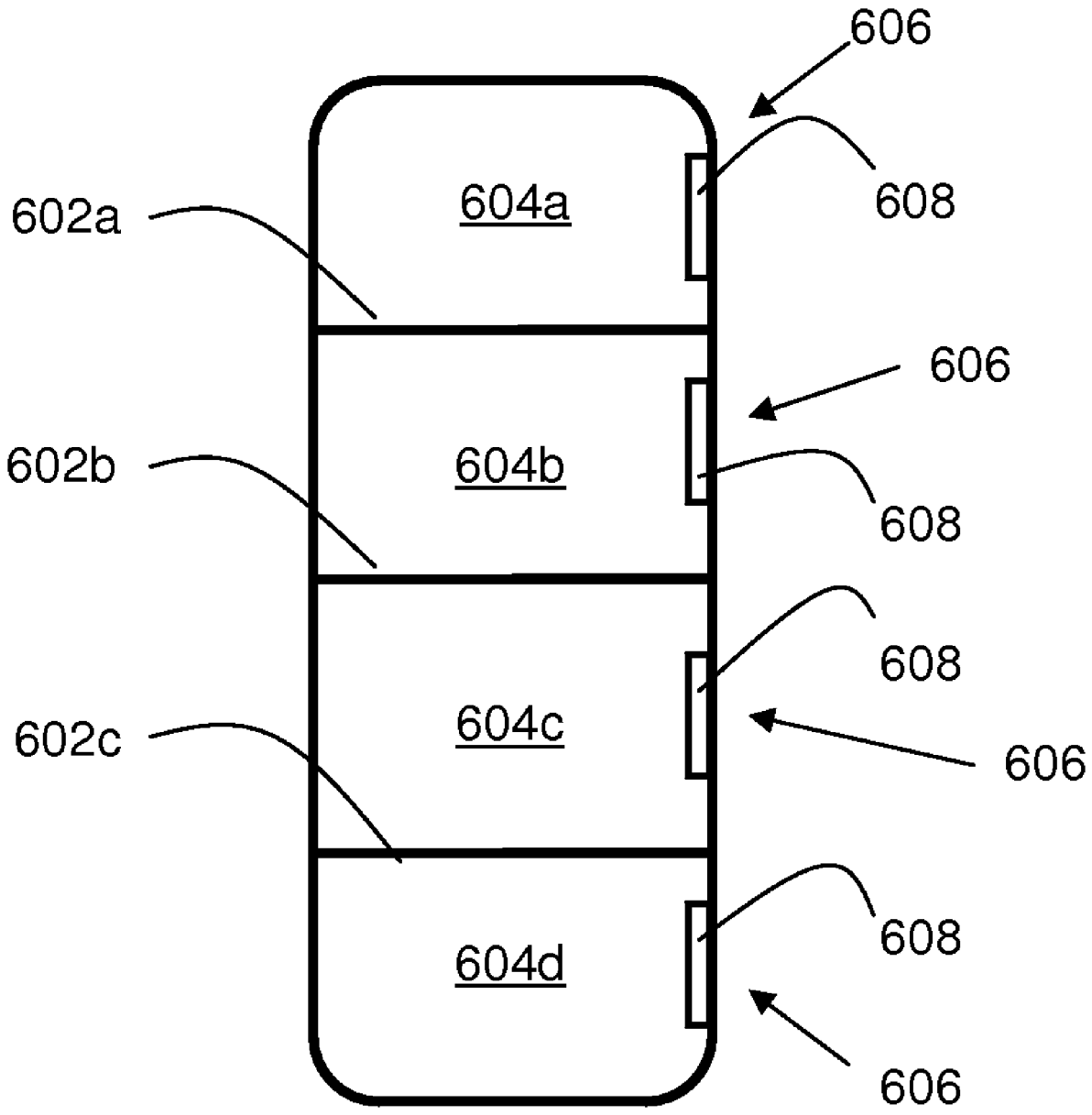

FIG. 6 illustrates an alternative embodiment multiple implosion canister (600). In this embodiment internal partitions (602*a*, 602*b*, 602*c*) define and isolate chambers (604*a*, 604*b*, 604*c*, 604*d*) from one another. Each chamber has an orifice (606) with a rupture disk (608) which is exposed to the fluid under pressure. Typically, the rupture disks (608) will have different implosion values. Advantages of this embodiment include simplified installation of rupture disks and avoidance of the need for internal baffles.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. Apparatus operable to facilitate calculation of a depth at which a condition occurs in a borehole containing a fluid, the borehole having a head and a bottom, comprising:

a hollow body which defines at least one chamber; and a feature which initiates generation of at least one tubewave based on exposure to a predetermined value of at least one physical property selected from the group including pressure, time, temperature, pH, and background radiation wherein, said hollow body is introduced into the fluid being pumped into the borehole via an inlet between a pump and the borehole head.

2. The apparatus of claim 1 wherein the body is spherical.

3. The apparatus of claim 1 wherein the body is cylindrical.

4. The apparatus of claim 1 wherein the body is constructed from at least one material selected from the group consisting of: metal, ceramic and glass.

5. The apparatus of claim 1 wherein the feature which initiates generation of at least one tubewave includes a triggering mechanism.

6. The apparatus of claim 1 wherein the feature which initiates generation of a tubewave includes an explosive charge operable in response to the triggering mechanism.

7. The apparatus of claim 1 wherein the feature which initiates generation of a tubewave includes a piezoelectric device operable in response to the triggering mechanism.

8. The apparatus of claim 1 wherein the feature which initiates generation of at least one tubewave includes a pressure rupture disk mounted in an orifice of the body.

9. The apparatus of claim 8 wherein rupture disk area is selected to produce a tubewave of a particular frequency.

10. The apparatus of claim 1 further including internal partitions which define a plurality of chambers.

11. The apparatus of claim 9 wherein each chamber includes at least one orifice formed in one of the internal partitions, and a pressure rupture disk mounted in the orifice.

12. The apparatus of claim 11 wherein at least one chamber includes internal baffles.

13. The apparatus of claim 11 further including an arming mechanism operable to shield the internal partitions from external pressure until the arming mechanism is actuated.

14. The apparatus of claim 1 wherein each at least one chamber includes an orifice and a pressure rupture disk mounted in the orifice, the pressure rupture disks being exposed to pressure external to the body.

15. The apparatus of claim 14 wherein the at least one chamber volume and the pressure rupture disk surface area are selected to produce particular amplitude and frequency characteristics for the at least one tubewave.

16. The apparatus of claim 1 wherein the at least one chamber volume is selected to produce a tubewave of a particular amplitude.

17. The apparatus of claim 1, wherein the hollow body comprises a canister operable in response to occurrence of the condition at a first position in the borehole to generate first and second tubewaves in the borehole, the first tubewave propagating from the position directly toward the head, and the second tubewave propagating from the position toward the bottom of the borehole and then being reflected toward the head;

at least one sensor operable to detect arrival of the first and second tubewaves at a second position of known depth; and an analyzer operable to calculate depth of the first position relative to the depth of the bottom of the borehole as a function of difference in detected arrival time of the first and second tubewaves at the second position.

18. The apparatus of claim 17 wherein the canister is operable to generate the first and second tubewaves by imploding.

19. The apparatus of claim 18 wherein the canister is designed to implode at a predetermined pressure.

20. The apparatus of claim 18 including a plurality of canisters, each of which implodes at a different pressure.

21. The apparatus of claim 17 wherein the analyzer is operable to produce a pressure versus depth profile of the well.

22. The apparatus of claim 17 wherein the analyzer is operable to distinguish the first and second tubewaves from other tubewaves based on amplitude.

23. Apparatus operable to calculate a depth at which a condition occurs in a borehole containing a fluid, the borehole having a head and a bottom, comprising:

a canister operable in response to occurrence of the condition at a first position in the borehole to generate first and second tubewaves in the well, the first tubewave propagating from the position directly toward the head, and the second tubewave propagating from the position toward the bottom of the borehole and then being reflected toward the head;

at least one sensor operable to detect arrival of the first and second tubewaves at a second position of known depth; and an analyzer operable to calculate depth of the first position relative to the depth of the bottom of the borehole as a function of difference in detected arrival time of the first and second tubewaves at the second position.

24. The apparatus of claim 23 wherein the canister is operable to generate the first and second tubewaves by imploding.

25. The apparatus of claim 24 wherein the canister is designed to implode at a predetermined pressure.

26. The apparatus of claim 25 including a plurality of canisters, each of which implodes at a different pressure.

27. The apparatus of claim 25 wherein the analyzer is operable to produce a pressure versus depth profile of the well.

28. The apparatus of claim 23 wherein the canister is operable to generate the first and second tubewaves by exploding.

29. The apparatus of claim 23 wherein the canister includes piezoelectric seismic source to generate the first and second tubewaves.

30. The apparatus of claim 23 wherein the canister is operable to trigger generation of the first and second tubewaves based on at least one physical property selected from the group including time, temperature, pH, and background radiation.

31. The apparatus of claim 23 wherein the analyzer is operable to distinguish the first and second tubewaves from other tubewaves based on frequency.

32. The apparatus of claim 23 wherein the analyzer is operable to distinguish the first and second tubewaves from other tubewaves based on amplitude.

33. A method for facilitating calculation of a depth at which a condition occurs in a borehole containing a fluid, the borehole having a head and a bottom, comprising:

generating at least one tubewave with an imploding hollow body which defines at least one chamber and a feature which initiates generation of the tubewave based on exposure to a predetermined value of at least one physical property selected from the group including pressure, time, temperature, pH, and background radiation.

34. The method of claim 33 wherein the body is spherical.

35. The method of claim 33 wherein the body is cylindrical.

36. The method of claim 33 wherein the body is constructed from at least one material selected from the group consisting of: metal, ceramic and glass.

37. The method of claim 33 including the further step of initiating generation of the at least one tubewave in response to a triggering mechanism.

38. The method of claim 33 including the further step of initiating generation of the at least one tubewave with a pressure rupture disk mounted in an orifice of the body.

39. The method of claim 38 wherein rupture disk area is selected to produce a tubewave of a particular frequency.

40. The method of claim 38 wherein the at least one chamber volume and the pressure rupture disk surface area are selected to produce particular amplitude and frequency characteristics for the at least one tubewave.

41. The method of claim 33 further including internal partitions which define a plurality of chambers.

42. The method of claim 41 wherein each chamber includes at least one orifice formed in one of the internal partitions, and a pressure rupture disk mounted in the orifice.

43. The method of claim 42 wherein at least one chamber includes internal baffles.

44. The method of claim 42 further including the step of employing an arming mechanism to shield the internal partitions from external pressure until the arming mechanism is actuated.

45. The method of claim 33 wherein each at least one chamber includes an orifice and a pressure rupture disk mounted in the orifice, the pressure rupture disks being exposed to pressure external to the body.

46. The method of claim 33 wherein the at least one chamber volume is selected to produce a tubewave of a particular amplitude.

47. The method of claim 33, further comprising:

generating, with the hollow body in response to occurrence of the exposure to a predetermined value, at a first position in the borehole, first and second tubewaves in the borehole, the first tubewave propagating from the position directly toward the head, and the second tubewave propagating from the position toward the bottom of the borehole and then being reflected toward the head;

detecting arrival of the first and second tubewaves at a second position of known depth with at least one sensor; and employing an analyzer to calculate depth of the first position relative to the depth of the bottom of the well as a function of difference in detected arrival time of the first and second tubewaves at the second position.

48. The method of claim 47 including the further step of the canister generating the first and second tubewaves by imploding.

49. The method of claim 47 wherein the hollow body is designed to implode at a predetermined pressure.

50. The method of claim 49 including a plurality of hollow bodies, each imploding at a different pressure.

51. The method of claim 47 including the further step of producing a pressure versus depth profile of the well with the analyzer.

52. A method for calculating a depth at which a condition occurs in a borehole containing a fluid, the borehole having a head and a bottom, comprising:

generating, with a canister operable in response to occurrence of the condition at a first position in the borehole, first and second tubewaves in the borehole, the first tubewave propagating from the position directly toward the head, and the second tubewave propagating from the position toward the bottom of the borehole and then being reflected toward the head;

detecting arrival of the first and second tubewaves at a second position of known depth with at least one sensor; and employing an analyzer to calculate depth of the first position relative to the depth of the bottom of the well as a function of difference in detected arrival time of the first and second tubewaves at the second position.

53. The method of claim 52 including the further step of the canister generating the first and second tubewaves by imploding.

54. The method of claim 52 including the further step of the canister generating the first and second tubewaves by exploding.

55. The method of claim 52 wherein the canister includes piezoelectric seismic source to generate the first and second tubewaves.

56. The method of claim 52 wherein the canister is designed to implode at a predetermined pressure.

57. The method of claim 56 including a plurality of canisters, each imploding at a different pressure.

58. The method of claim 56 including the further step of producing a pressure versus depth profile of the well with the analyzer.

59. The method of claim 52 including the further step of triggering, with the canister, generation of the first and second tubewaves based on at least one physical property selected from the group including time, temperature, pH, and background radiation.

60. The method of claim 52 including the further step of the analyzer distinguishing the first and second tubewaves from other tubewaves based on frequency.

61. The method of claim 52 including the further step of the analyzer distinguishing the first and second tubewaves from other tubewaves based on amplitude.

* * * * *